US006698925B2

(12) United States Patent
Bentsen

(10) Patent No.: US 6,698,925 B2
(45) Date of Patent: Mar. 2, 2004

(54) RECLOSABLE PACKAGING HAVING ZIPPER WITH MEANS FOR MAINTAINING CLOSURE

(75) Inventor: Per Bentsen, Suffern, NY (US)

(73) Assignee: Illinois Tool Works Inc., Glenview, IL (US)

( * ) Notice: Subject to any disclaimer, the term of this patent is extended or adjusted under 35 U.S.C. 154(b) by 15 days.

(21) Appl. No.: 10/170,867

(22) Filed: Jun. 13, 2002

(65) Prior Publication Data

US 2003/0231809 A1 Dec. 18, 2003

(51) Int. Cl.[7] ..... B65D 33/16
(52) U.S. Cl. ..... 383/63; 383/64; 24/400
(58) Field of Search ..... 383/63, 64, 65, 383/68, 69; 24/585.12, 399, 400, DIG. 50

(56) References Cited

U.S. PATENT DOCUMENTS 1,703,712 A * 2/1929 Aud ..... 383/64
3,579,747 A 5/1971 Hawley
3,700,019 A * 10/1972 Robbins et al. ..... 383/59
4,796,300 A * 1/1989 Branson ..... 383/63
5,664,296 A * 9/1997 May ..... 24/30.5 R
6,354,738 B1 3/2002 Buckman et al.

FOREIGN PATENT DOCUMENTS

WO WO092016424 A * 10/1992 ..... 383/68

* cited by examiner

*Primary Examiner*—Jes F. Pascua
(74) *Attorney, Agent, or Firm*—Ostrager Chong & Flaherty LLP

(57) ABSTRACT

A fastener for a reclosable package comprises a flexible zipper and a string for maintaining zipper closure. The fastener may optionally further comprise a slider for pressing the string into a groove on the zipper and/or extracting the string from the groove. In one embodiment, the fastener comprises first and second zipper parts and a string. The first zipper part comprises a rib. The second zipper part comprises a first body, a second body and a narrow strip connecting the first and second bodies. The first and second bodies and the narrow strip define first and second grooves having respective openings on opposing sides of the second zipper part. The first groove is profiled to receive and hold the string, while the second groove is profiled to receive and hold the rib.

23 Claims, 6 Drawing Sheets

RECLOSABLE PACKAGING HAVING ZIPPER WITH MEANS FOR MAINTAINING CLOSURE

BACKGROUND OF THE INVENTION

This invention generally relates to flexible zippers for use in reclosable pouches, bags or other packages of the type in which perishable material, such as foodstuff, may be stored.

Reclosable fastener assemblies are useful for sealing thermoplastic pouches or bags. Such fastener assemblies often include a plastic zipper and a slider. Typically, the plastic zippers include a pair of interlockable fastener elements, or profiles, that form a closure. As the slider moves across the profiles, the profiles are opened or closed. The profiles in plastic zippers can take on various configurations, e.g. interlocking rib and groove elements having so-called male and female profiles, interlocking alternating hook-shaped closure elements, etc.

Conventional slider-operated zipper assemblies typically comprise a plastic zipper having two interlocking profiles and a slider for opening and closing the zipper. In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction.

Other types of slider-operated zipper assemblies avoid the use of a separating finger. For example, U.S. Pat. No. 6,047,450 discloses a zipper comprising a pair of mutually interlockable profiled structures in which portions of the two profiled structures form a fulcrum about which the profiled structures may be pivoted out of engagement when lower edges of the bases are forced towards each other by the slider.

In the case of sliders having a separating finger or post for separating the zipper profiles, it is usually necessary to have the finger or post extend into the product side of the package. Since the zipper halves are relatively rigid, they do not conform to the shape of the post and a gap is left between the post and the point where the zipper halves are fully mated. This gap creates a potential for liquid and gas leakage from or into the package. From this standpoint, sliders without separating fingers or posts are an improvement.

Under circumstances that produce high forces tending to separate the profiles of a closed zipper, it is known that some zippers are more susceptible than others to being accidentally opened. This is especially true for large bags. For example, high separating forces can be generated during handling of a reclosed bag, the magnitude of the force being sufficient to cause the bag to open accidentally. There is a need for a zipper design having positive means for securing a reclosed flexible zipper against accidental opening.

BRIEF DESCRIPTION OF THE INVENTION

The invention is directed in part to a means for maintaining closure of a flexible zipper in a reclosable package. The invention is also directed in part to a fastener having such closure-maintaining means and to a reclosable package having such a fastener. The invention is further directed in part to a method of reclosing such a fastener. The fasteners disclosed herein comprise a flexible zipper and a device for maintaining closure of the zipper. In addition, to preventing accidental opening of the zipper, the zipper and closure-maintaining device may be designed so that the zipper closure becomes watertight when the closure-maintaining device, e.g., a string of extruded plastic, is inserted in the zipper, e.g., in a groove formed on the backside of the zipper half having a female profile.

The fastener may further comprise a slider for pressing the closure maintaining device into a groove on the zipper and/or extracting the closure maintaining device from the groove. Sliders may be designed that perform the dual functions of closing the zipper ahead of securing the closure as the slider is moved in the closing direction. Conversely, the slider can additionally or alternatively be designed to perform the dual functions of removing the closure-securing device ahead of disengaging the zipper parts when the slider is moved in the opening direction.

One aspect of the invention is a fastener comprising first and second zipper parts and a string, wherein the first zipper part comprises a first interlockable portion and the second zipper part comprises a second interlockable portion on one side of the second zipper part and a groove having an opening on an opposite side of the second zipper part. The interlockable portions are mutually interlockable. The string is seated in the groove. Optionally, the string is inserted in and/or removed from the groove by operation of a slider.

Another aspect of the invention is a fastener comprising first and second zipper parts and a string, wherein the first zipper part comprises a rib, and the second zipper part comprises a first body, a second body and a narrow strip or neck connecting the first and second bodies. The first and second bodies and the narrow strip define first and second grooves having respective openings on opposing sides of the second zipper part. The first groove is profiled to receive and hold the string, while the second groove is profiled to receive and hold the rib.

A further aspect of the invention is a package comprising: a receptacle having an interior volume and a mouth; and a fastener comprising a string and first and second interlockable zipper parts that are interlocked to close the mouth and separated to open the mouth. The first zipper part comprises a rib, and the second zipper part comprises a first body, a second body and a narrow strip connecting the first and second bodies. The first and second bodies and the narrow strip define first and second grooves having respective openings on opposing sides of the second zipper part. The first groove is profiled to receive and hold the string, while the second groove is profiled to receive and hold the rib.

Yet another aspect of the invention is a package comprising: a receptacle having an interior volume and a mouth; and a fastener comprising a string and first and second interlockable zipper parts that are interlocked to close the mouth and separated to open the mouth. The first zipper part comprises a first interlockable portion, while the second zipper part comprises a second interlockable portion on one side of the second zipper part and a groove having an opening on an opposite side of the second zipper part. The first and second interlockable portions are mutually interlockable, and the string is at least partially insertable in the groove.

A further aspect of the invention is a method of reclosing a reclosable bag having male and female zipper parts, comprising the following steps: pressing a rib of the male zipper part into a first groove formed in the female zipper part; and while the rib is inside the first groove, pressing a string into a second groove formed in the female zipper part on a side opposite to the second groove.

Another aspect of the invention is a zipper tape comprising first and second plastic zipper parts and a plastic string having a constant profile. The first zipper part comprises a rib having a constant profile and the second zipper part comprises upper and lower bodies connected by a neck and forming first and second grooves of constant profile on opposite sides of the neck. The first groove is interlockable with the rib, whereas the string is at least partially insertable inside the second groove. The neck forms a hinge allowing the upper body to pivot relative to the lower body to widen a mouth of the first groove when the string is not seated inside the second groove. This pivoting action is substantially blocked when the string is seated in the second groove.

Yet another aspect of the invention is a slider for operating a flexible zipper, comprising a housing having a passageway and a post disposed off-center in the passageway. The post has a vertical axis and a rounded profile. The housing comprises a top wall generally transverse to the vertical post, and first and second side walls connected to and projecting downward from opposing sides of the top wall. The vertical post is disposed between the first and second side walls. The top wall comprises a tapered shoulder having a surface that has a curved contour that is constant in the vertical direction and that faces toward the post and away from the second side wall.

Another aspect of the invention is a slider for operating a flexible zipper, comprising a top wall, first and second side walls connected to and projecting downward from opposing sides of the top wall, and first and second inwardly directed projections projecting from the bottoms of the first and second side walls respectively, wherein one of the side walls comprises a cutout that extends in a longitudinal direction from one end of that side wall to an intermediate portion thereof.

Other aspects of the invention are disclosed and claimed below.

BRIEF DESCRIPTION OF THE DRAWINGS

FIG. 5 shows the zipper in a closed state; FIG. 6 shows the zipper in a partly opened state.

DETAILED DESCRIPTION OF THE INVENTION

Figure 1:
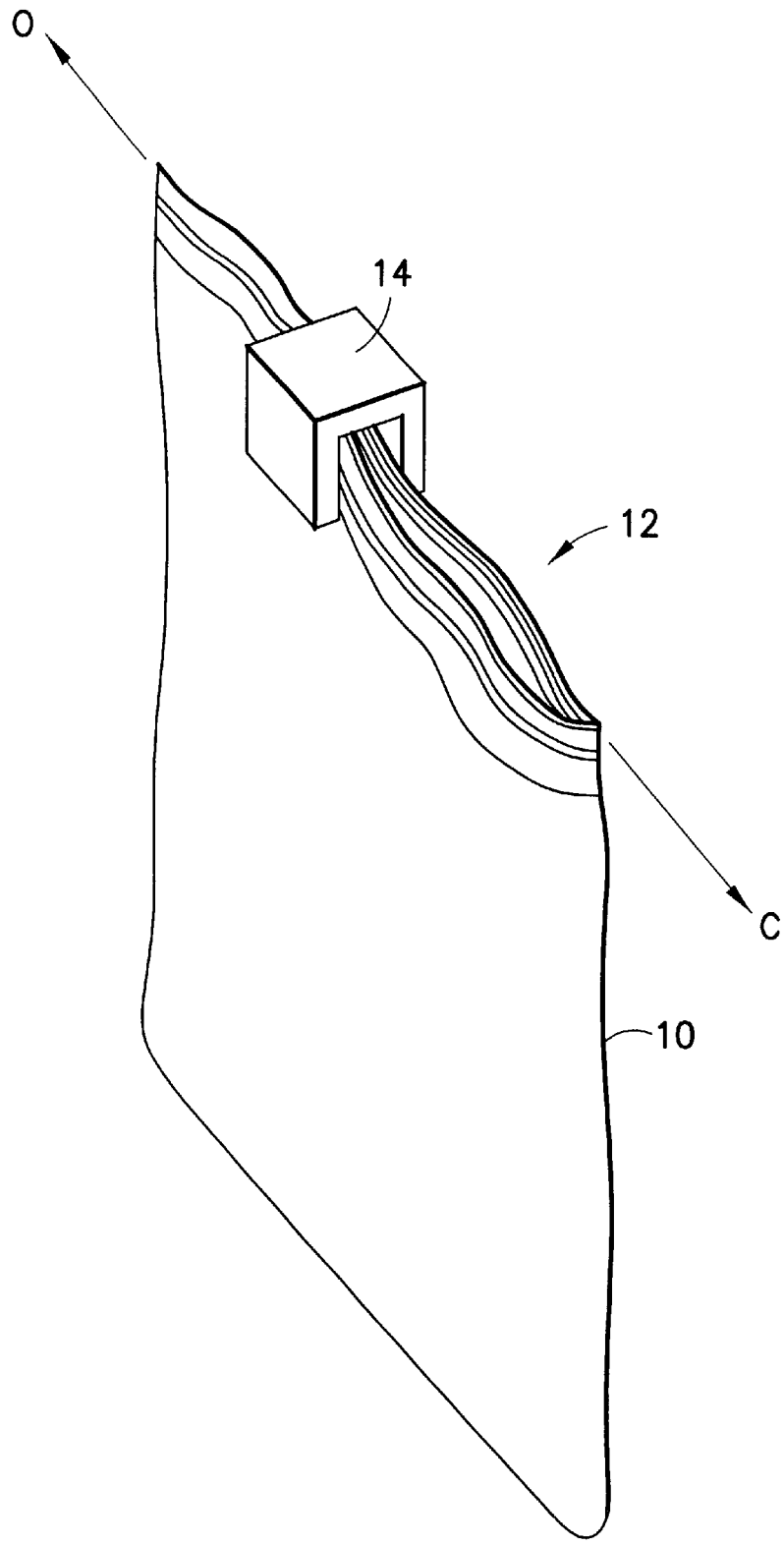
FIG. 1 is a schematic showing an isometric view of a reclosable package having a slider-operated flexible zipper.

Reference will now be made to the drawings, in which similar elements in different drawings bear the same reference numerals. A reclosable bag 10 having a flexible plastic zipper 12 operated by manipulation of a slider 14 is shown in FIG. 1. It should be understood that the slider-zipper assemblies disclosed herein can be installed in a reclosable bag of the type shown in FIG. 1 or other types of reclosable packages having different structures. It should be further understood that the invention disclosed herein also has application in different types of reclosable bags that have a flexible zipper but not a slider.

Still referring to FIG. 1, the bag 10 may be made from any suitable sheet material or plastic film and comprises opposite wall panels, which may be secured together at opposite side edges of the bag by seams (not shown). The opposing bottoms of the wall panels may be joined, for example, by means of a heat seal made in conventional fashion, e.g., by application of heat and pressure or ultrasonic energy. Typically, however, the bottom of the package is formed by a fold in the original packaging film. Optionally, the bag may be provided with side gussets having respective junctures with the front and rear wall panels. In the latter case, the bag may also be provided with a bottom panel having respective junctures with the front and rear wall panels and with the side gussets.

At its top end, the bag 10 has an openable mouth, on the inside of which is an extruded plastic zipper 12. The zipper 12 comprises a pair of interlockable fastener strips or zipper halves. For the embodiments disclosed herein, the profiles of the zipper halves comprise interlocking rib and groove elements. The preferred zipper material is polyethylene.

The front and rear bag wall panels are respectively sealed to the zipper halves 16 and 18 by heat fusion or welding. Attentively, the interlockable zipper halves can be attached to the wall panels by adhesive or bonding strips. For this purpose, each zipper half may be provided with a respective extension flange, to which an upper portion of the respective bag wall panel is fused or welded. The walls of the bag may be formed of various types of thermoplastic material, such as low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive.

In zippered bags with sliders, as the slider moves across the zipper, the zipper is opened or closed. As shown in FIG. 1, the slider is slidable along the zipper in a closing direction "C", causing the zipper halves to become engaged, or in an opening direction "O", causing the zipper halves to become disengaged.

The slider for opening or closing the reclosable zipper is generally shaped so that the slider straddles the zipper profiles. The slider may be made in multiple parts and welded together or the parts may be constructed to snap together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

A bag incorporating a zipper and a slider preferably includes means, such as end stops (not shown in FIG. 1), for preventing the slider from sliding off the end of the zipper when the slider reaches the closed or fully opened position. Such end stops perform dual functions, serving as stops to prevent the slider from going off the end of the zipper and also holding the two zipper profiles together to prevent the bag from opening in response to stresses applied to the profiles through normal use of the bag. The end stops may, for example, comprise stomped areas on the zipper profiles themselves, riveted end clamps, plastic end clips fused to the zipper, or any other suitable structure. The stomped end stops can be sections of the profiles that are fused together proximate to the open and closed slider positions such that the end stops are raised. Stomping can be carried out by, for example, applying heat and/or pressure or using ultrasonic methods.

The zipper halves preferably comprise interlocking rib and groove elements, which are well known in the art. Many configurations of rib and groove elements may be employed to perform any one of a number of required functions. For instance, specific rib and groove elements may be employed to permit the package to be more easily opened from the outside than from the inside, so that the tension produced by the contents of the package will not accidentally open the rib and groove elements. The rib and groove elements may be carefully formed of a soft flexible material in part thereof so that the contents of the package are in fact relatively hermetically sealed from the outside.

Figure 2:
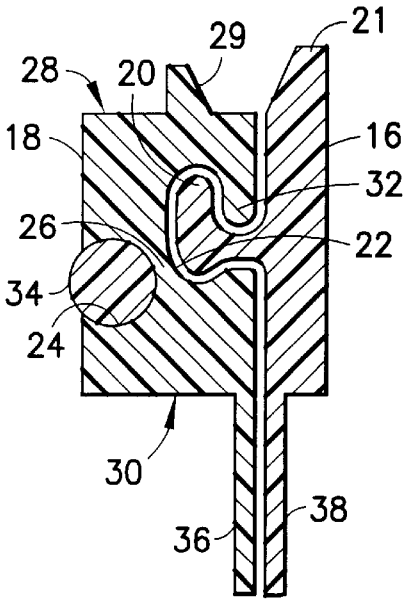
FIGS. 2–4 are schematics showing sectional views of respective zippers having a groove formed in the zipper part of female profile for receiving a string in accordance with various embodiments of the invention.

In accordance with one embodiment of the present invention, the zipper halves 16 and 18 have the profiles shown in FIG. 2. Zipper half 16 has a rib 20 with a male profile, while zipper half 18 has a first groove 22 with a female profile for receiving rib 20, thereby interlocking the zipper halves together. In addition, the zipper half 18 has a second groove 24 that runs parallel to the first groove 22 and opens on the side of zipper half 18 opposite to the side on which first groove 22 opens. The grooves 22 and 24 are separated by a neck or narrow strip 26 of zipper material. Preferably the second groove 24 has a profile defined by an arc greater than 180 degrees, for reasons that will be made apparent below.

The narrow strip 26 of flexible zipper material allows the zipper half 18 to flex easily, thereby producing the effect of the upper half 28 (i.e., the portion above the neck 26) of the zipper half 18 pivoting relative to the lower half 30 (i.e., the portion below the neck 26) of the zipper half 18. In particular, the upper portion 28 of zipper half 18 can rotate in a counter-clockwise direction (in the view presented in FIG. 2) relative to the lower portion 30 of zipper half 18. Such flexure in the counter-clockwise direction causes the mouth of groove 22 to widen, making it easier for rib 20 to enter groove 22 during an attempt by the bag user to reclose the zipper. For example, when the zipper halves 16 and 18 are pressed together, the rib 20 contacts and pushes the lip 32 backward and upward. This in turn causes the upper portion 28 to flex relative to the lower portion 30 of zipper half 18. When the rib 20 is fully inserted in groove 22, the upper portion 28 can then return to the unflexed position shown in FIG. 2. However, in this interlocked position, external forces could be applied that would cause the upper portion 28 to again flex counterclockwise, possibly resulting in disengagement of rib 20 from groove 22.

Such accidental disengagement of the rib and groove is prevented by inserting a string 34 into the second groove 24. Preferably the string has a circular profile with a diameter equal to or slightly less than the diameter of the second groove 24. When the string 34 is inserted in groove 24, string 34 resists counter-clockwise flexure of the upper portion 28 relative to the lower portion 30 of zipper half, effectively stiffening the neck 26. Thus the resistance to disengagement of the rib 20 from the groove 22 is increased and the zipper is secured in its closed state, as seen in FIG. 2.

The string 34 can be manually inserted in the groove 24 by the user of the reclosable bag. Using two digits, for example, a forefinger and opposing thumb, the user first presses the zipper halves together to close the bag and then, when the rib and groove are interlocked, presses the string 34 into the groove 24 to secure closure of the bag, thereby increasing the resistance of the bag to accidental opening.

Similarly, opening of the closed bag is a two-step operation. First, the string 34 is removed from the groove 24, either by pulling it out by its loose end tab 42 or as described below. Then the groove 22 is disengaged from rib 20 by pulling the zipper halves 16 and 18 apart. This can be accomplished by applying a separating force to steps 21 and 29. Three alternative configurations for steps 21 and 29 are respectively depicted in FIGS. 2–4. In each embodiment, step 21 is integrally formed with the zipper half 16, while step 29 is integrally formed with the zipper half 18.

Figure 3:
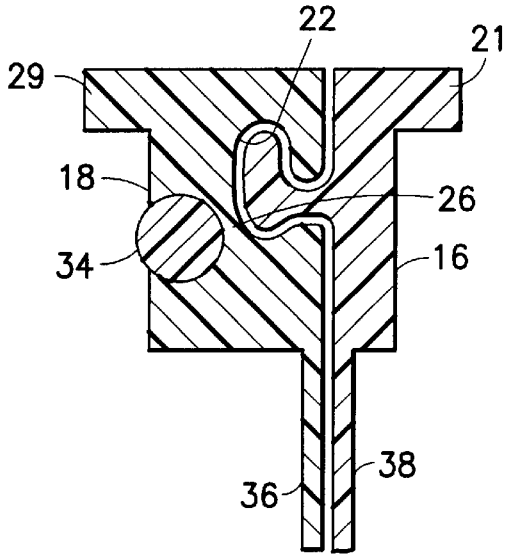
Figure 4:
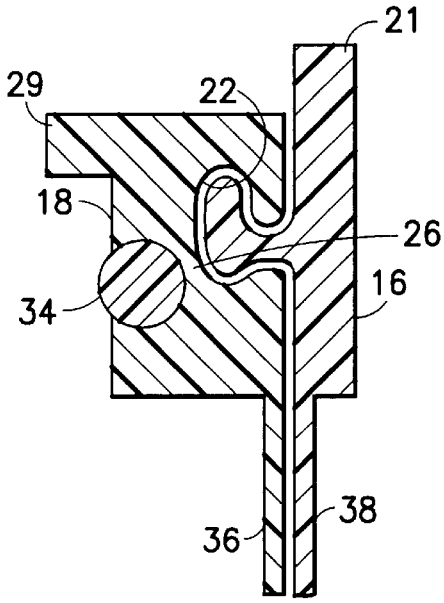

In the embodiments depicted in FIGS. 2–4, each zipper half further comprises a respective extension flange 36 and 38. One of the front and rear walls or panels of the bag are joined to the outer surface of extension flange 36 of the zipper half 18, while the other of the front and rear walls or panels of the bag are joined to the outer surface of extension flange 38 of the zipper half 16. Alternatively, zipper halves without extension flanges could be extruded directly onto or together with the film used to form the front and rear panels of the bag.

Figure 5:
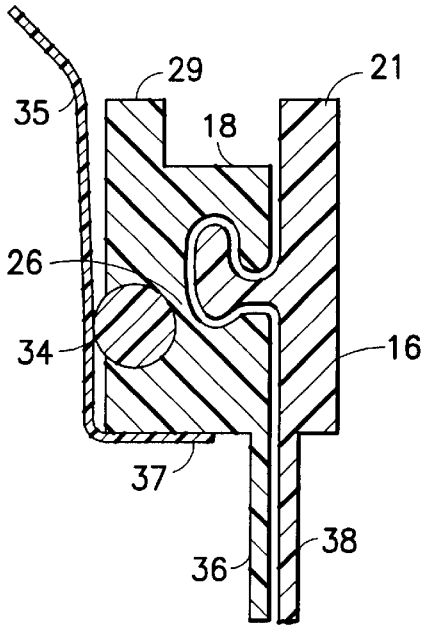
FIGS. 5 and 6 are schematics showing sectional views of a zipper having a string in a groove wherein the string is attached to a film and removable from the groove by manipulation of the film in accordance with a further embodiment of the invention. The zipper is shown closed and locked in FIG. 5 and unlocked and partially disengaged in FIG. 6.
Figure 6:
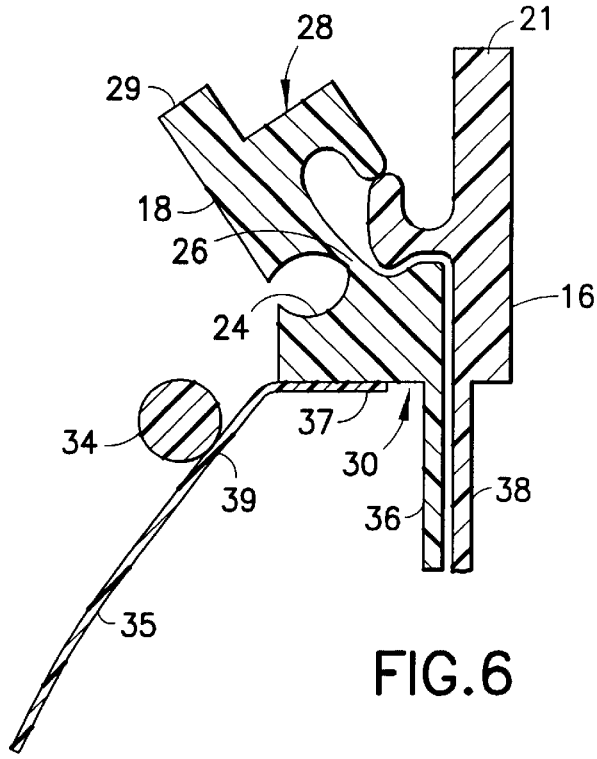

In another embodiment, depicted in FIGS. 5 and 6, the string 34 is attached or joined to a plastic film 35, which is in turn attached to the zipper part 18 that has the groove for receiving the string. The bottom portion 37 of the film 35 is sealed to the bottom face of the female zipper half 18. The string 34 can be removed from groove 24 by pulling the unattached portion of film 35 away from zipper half 18. This allows the upper portion 28 of zipper half 18 to rotate relative to the lower portion 30 as the zipper halves are pulled apart using steps 21 and 29. As a result, the zipper profiles disengage and the zipper can be opened. After the zipper has been reclosed, the bag user can manually push the string 34 back into groove 24 to secure the zipper closed. The string 34, film 35 and zipper half 18 can be manufactured separately and then joined or extruded together.

Optionally, a slider 40 (indicated by dashed lines in FIG. 7) may be operated to push the string 34 into the second groove 24. One embodiment of a slider/zipper assembly is depicted in FIG. 8.

Figure 8:
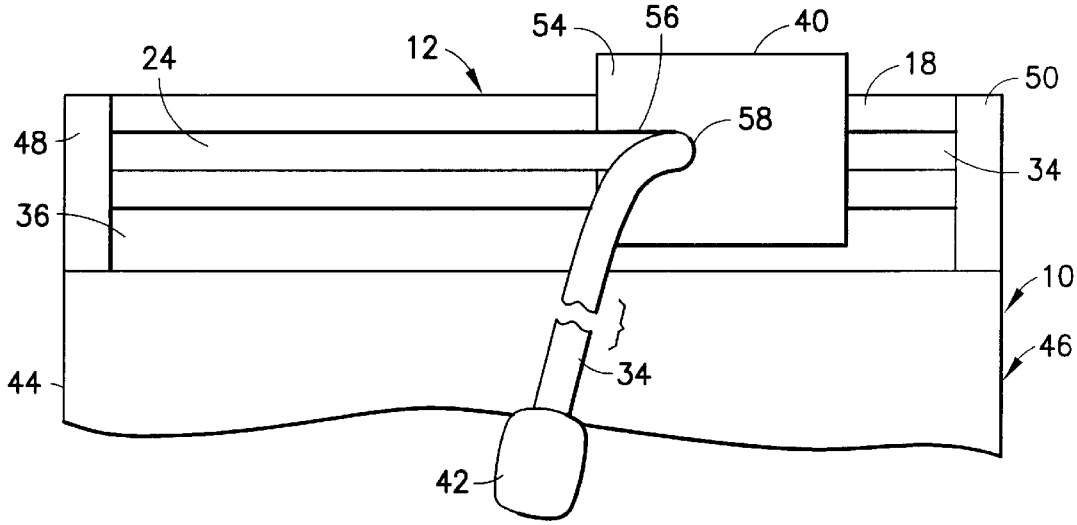
FIG. 8 is a schematic showing an elevational view of the top portion of a bag having a slider-operated zipper in accordance with another embodiment of the invention.

FIG. 8 shows an alternative embodiment of a reclosable bag 10 having a flexible plastic zipper 12, a slider 40 and a flexible plastic security string 34, with a pull tab 42 on one end, of the type previously described. The bag 10 is sealed along the side edges 44 and 46. The zipper 12 has stomped end areas 48 and 50 where the zipper halves are stomped or fused together, as previously described. The zipper can be opened only along the zipper portion extending between the stomped end areas and only after the security string 34 has been removed.

To remove the string 34 from the groove 24, optionally a pull tab 42 (or other suitable device that can be gripped between a thumb and a forefinger) is provided on one end of the string, as seen in FIG. 8. The string 34 is preferably made longer than the groove 24, so that a terminal portion of the string that carries the pull tab 42 will project out of the groove 24 when the latter is substantially filled along almost its entire length by the string. The pull tab can be provided at the end of the string for zippers not operated by a slider as well as those operated by a slider.

In the embodiment depicted in FIG. 8, closing of the zipper is a one-step operation, namely, the slider 40 is moved from right to left. However, the slider is designed to perform two functions in succession as it travels along the zipper. First, the leading portion 54 of the slider, as it travels leftward in FIG. 8, will press the zipper profiles together so that the rib and groove are engaged. Second, an intermediate portion 58 of the slider presses the string 34 into the groove 24 along a portion of the zipper that has already been closed in the first operation. In other words, at any given section of the zipper, the string is not inserted into the groove until after the zipper halves have been engaged. This lag in string insertion is achieved by providing a slot 56, through which the string 34 is threaded, in the slider wall on the string side of the zipper. This arrangement places the point of string insertion behind the point of zipper engagement during leftward slider movement, so that first a zipper section is closed and then that closed section is secured.

In accordance with the embodiment depicted in FIG. 8, opening the package or bag is a three-step process. First, the slider is moved as far away from the pull tab as possible. Second, the user grabs the pull tab 42 between a forefinger and an opposing thumb and pulls on the tab to pull the string 34 out of the groove 24. Third, when the string 34 is substantially completely removed from the groove 24, the user can then pry the zipper halves open, as previously described.

Figure 7:
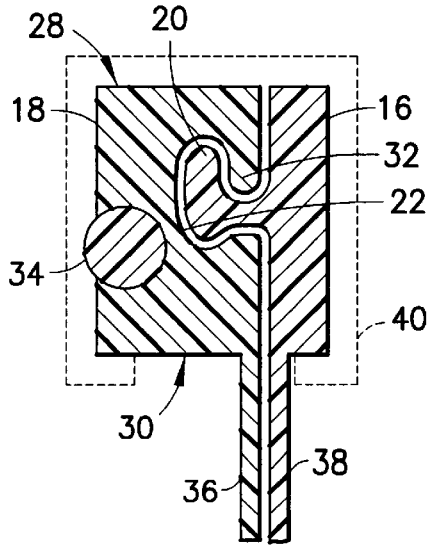
FIG. 7 is a schematic showing a sectional view of the same zipper depicted in FIG. 2, except that a slider has been added.

As best seen in FIG. 7, the slider 40 comprises a top wall 40, a pair of sidewalls connected to the top wall and extending in parallel in a downward direction, and a pair of projections facing inward and respectively connected to the sidewalls. The slider has an inverted U-shape with the slider being held on the zipper by the projections. The slider has an interior passage in which a section of the zipper is seated. The slider rides on the zipper smoothly and without play. The interior passage of the slider is designed such that as the slider is moved in the closing direction, the portion of the string 34 that engages the slider is guided toward and pressed into the groove 24 after the zipper parts have been engaged. The slider may be further designed to perform the same function when moved in the opposite direction, namely, guide and press the string into the groove in the event that part of the inserted string sticks out of the groove, e.g., in the event that the zipper undergoes bending. The slider in the embodiment shown in FIG. 8 does not have means for removing the string 34 from the groove 24. After the slider has been moved to the far right, as seen in FIG. 8, the string can then be pulled out of groove 24 using the pull tab 42, as previously described. The string 36 can be replaced back into the groove thereafter by sliding the slider to the left in FIG. 4.

In accordance with further embodiments of the invention, the slider has means for guiding and pressing the string 34 into the groove 24 when the slider is moved in one direction along the zipper and means for extracting the string 34 from the groove 24 when the slider is moved in the opposite direction. In these embodiments, the string is preferably attached at both ends to the ends of the zipper. One such embodiment is depicted in FIGS. 9–11; another is depicted in FIGS. 12 and 13.

Figure 9:
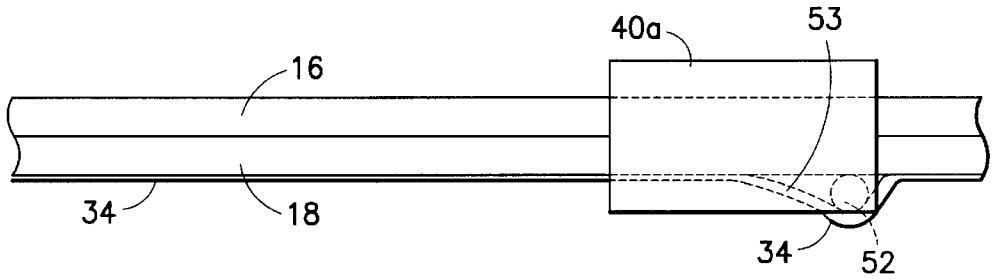
FIGS. 9 and 10 are schematics showing top views of a portion of a slider-zipper assembly in accordance with a further embodiment of the invention wherein the slider has a finger or post for separating a string from a groove in the zipper.
Figure 10:
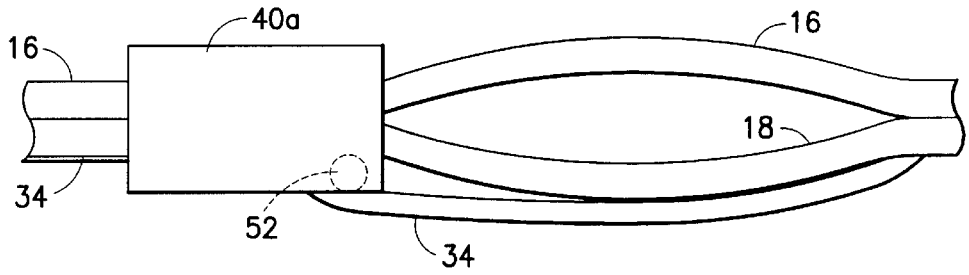
Figure 11:
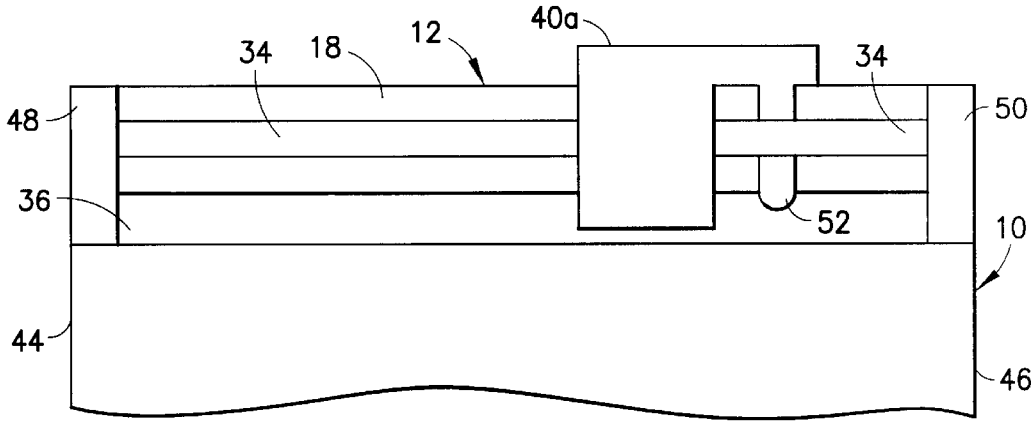
FIG. 11 is a schematic showing an elevational view of the top portion of a zippered bag in accordance with the embodiment depicted in FIGS. 9 and 10.

In the embodiment shown in FIGS. 9–11, the string 34 is secured at its ends by stomping of zipper end areas 48 and 50. In this embodiment, string extraction is accomplished by providing a slider 40*a* that has a separating finger 52. The separating finger 52 is supported by the slider housing and is located off-center and outside the longitudinal projection of the profile of the interior passage of the slider. The separating finger 52 extends vertically downward from the top wall of the slider and is located to one side of the zipper in a position where the finger 52 can be inserted between the zipper and the string 34. Preferably, the separating finger is a post having a circular cross-sectional profile, as seen in FIGS. 9 and 10. Alternatively the cross-sectional profile can be elliptical, a square, rectangle or triangle with rounded vertices, or any other suitable profile. The separating finger may alternatively take the form of a plow having a cross-sectional profile with a rounded apex that pries the string and zipper apart as the slider moves from right to left in FIG. 11. As shown in FIG. 9, the interior of the slider 40*a* has a deflecting or camming surface 53 for impressing the string 34 into the groove in zipper half 18 when the slider is moved from left to right in FIG. 11.

Figure 12:
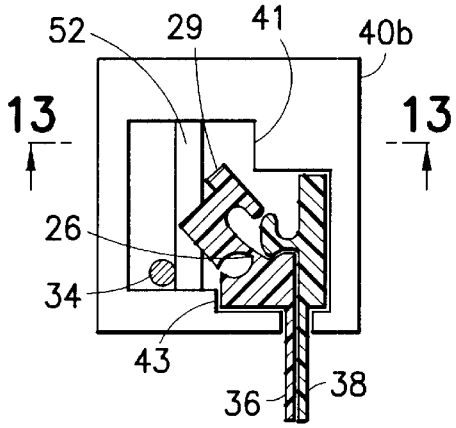
FIG. 12 is a schematic showing a sectional view of a slider-operated zipper in accordance with another embodiment of the invention. The slider has a finger or post that separates the string from the zipper and a wedge that separates the zipper halves from each other.
Figure 13:
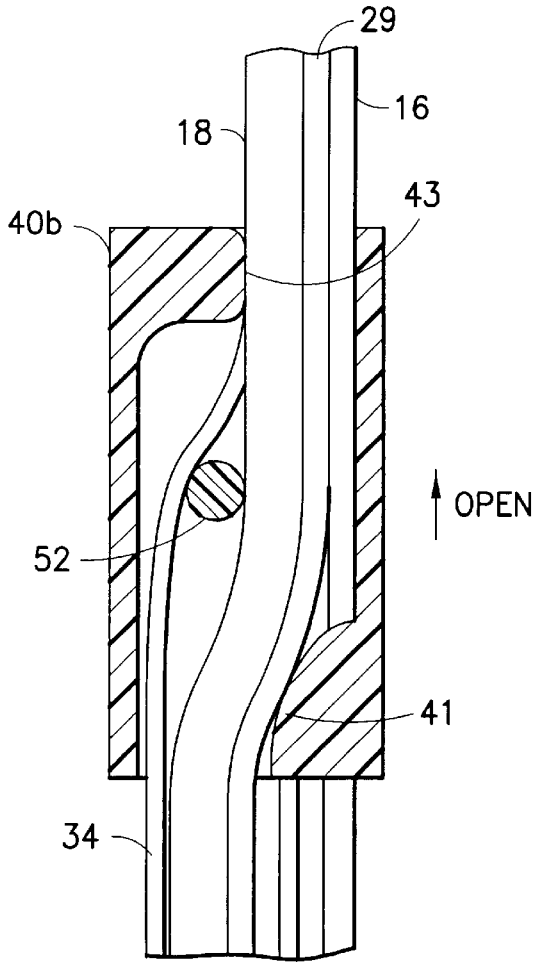
FIG. 13 is a schematic showing a sectional view of the slider-zipper assembly depicted in FIG. 12, the section being taken along line 13—13 indicated in FIG. 12.

In contrast to the embodiment of FIGS. 9–11, in which the slider has no means for separating the zipper halves to open the zipper, the slider 40*b* in the embodiment shown in FIGS. 12 and 13 is designed to operate both the security string and the zipper. These operations are performed in sequence, mot simultaneously, because the zipper must first be unlocked before it can be opened, and must locked or secured after the zipper has been closed.

The slider 40*b* comprises a top wall having a tapered shoulder 41, side walls connected to and projecting downward from opposing sides of the top wall, and a bottom wall connected to the bottom of one side wall and having a tapered shoulder 43. The slider further comprises a post or pin 52 having a rounded (e.g., circular) profile and a vertical axis. The pin 52 is disposed off-center in the passageway between the side walls. Each tapered shoulder 41 and 43 comprises a surface having a curved contour that is constant in the vertical direction. Tapered shoulder 41 faces toward the pin 52; tapered shoulder 43 faces away from pin 52.

As the slider 40*b* is moved in the opening direction (upward in FIG. 13), pin 52 will remove string 34 from the groove in zipper half 18. The tapered shoulder 41 is longitudinally displaced relative to the pin 52, i.e., to the rear of the slider adjacent the opening end. This tapered shoulder 41 applies increasing side pressure to a raised step 29 (see FIG. 12) at the top of zipper half 18 during movement of the slider in the opening direction, causing the upper portion of the female zipper half to rotate out of engagement with the male zipper half, using the narrow neck 26 as a hinge, as seen in FIG. 12. The sections of the zipper halves lying in the wake of the moving slider will then separate fully as they clear the slider.

When the slider 40*b* is moved in the closing direction (downward in FIG. 13), another tapered shoulder 43 (see FIG. 12) of the slider 40*b* cams or deflects the lower portion of the zipper half with the female profile against the zipper half with the male profile; then the pin 52 cams or deflects the upper portion of the female zipper half against the male zipper half to cause the rib and groove to engage. Thereafter, the camming surface 43 (see FIG. 13) presses the string 34 into the groove 26 of the female zipper half, securing the zipper in a closed state. Thus, the pin 52 in the embodiment depicted in FIGS. 12 and 13 performs two functions: prying the string 34 out of groove 24 when the slider moves in the opening direction; and pressing the upper portion of the female zipper half into engagement with the male zipper half when the slider moves in the closing direction.

The person skilled in the art will readily appreciate that other slider structures could be designed to interact with the string. For example, instead of a separating finger, the slider could be formed with a tunnel through which the string 34 is threaded. In the case where the string has a circular cross section, the tunnel would preferably also have a circular cross section. Although the tunnel would be disposed in the same horizontal plane as the groove 24, the tunnel would be curved in such a way that one portion of its interior surface acted as a plow for prying the string 34 out of the groove 24 when the slider is moved in one direction, while another portion of tunnel's interior surface acted as a funnel for guiding the string 34 into the groove 24 when the slider is moved in the opposite direction.

In a further embodiment of the invention, the slider can be formed with a pair of deflecting surfaces that interact with the string. One deflecting surface interacts with the string at the place where it protrudes out of the longitudinal groove 24, that deflecting surface functioning in the manner of a plow as previously described, while the other deflecting surface funnels the adjacent portion of the string into the groove.

The slider with finger for separating the security string from the zipper half with the female profile can be a monolithic structure made by injection molding or can be constructed from separately injection-molded parts. The string 34 must be made of a strong, yet flexible material, to enable repeated bending of the type seen in FIG. 9. Suitable materials include, but are not limited to, nylon, polypropylene and polyethylene. The string and zipper can be made of the same material or different materials. For example, the zipper may be made of any thermoplastic material known in the art including, but not limited to, polyethylene, nylon, terephthalate, ethylene vinyl alcohol, polyvinyl dichloride, polypropylene, or polyolefin.

Methods for attaching a zipper or a slider-zipper assembly to a plastic bag are well-known in the art and will not be described in detail here. Methods for extruding plastic zipper parts are also well-known. For embodiments in which the security string is attached to the female zipper profile by means of a film, the string, zipper half and film can all be extruded as one piece.

Figure 14:
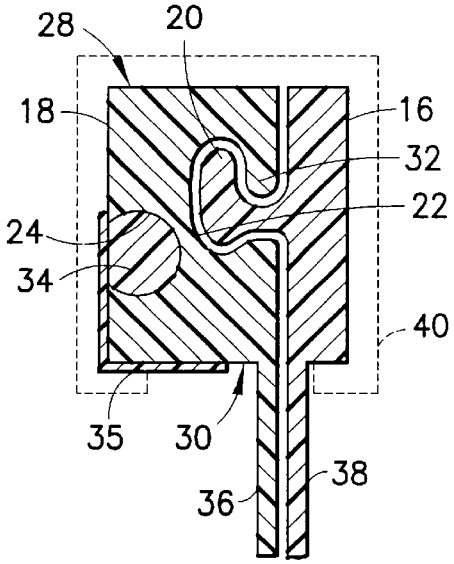
FIG. 14 is a schematic showing a sectional view of a further embodiment combining a string-carrying film attached to a slider-operated zipper.

The concept of attaching the security string to female zipper profile by means of a film can be extended to slider-operated zippers, as exemplified by the embodiment depicted in FIG. 14. The string 34 is in the form of a circular cylinder having a flat face to which one end of the film 35 is joined. The flat face is generally flush with the adjacent exterior surface of the female zipper half 18. The other end of the film 35 is joined to the exterior surface of the bottom of the female zipper profile 18. The slider is of the type having a leading portion that engages the zipper profiles and a lagging portion that presses the security string 34 inside the groove 24 when the slider is moved in the closing direction. Conversely, the slider first removes the string out of the groove and then disengages the zipper profiles when the slider is moved in the opening direction. The slider should be designed to provide clearance for the film 35 as the slider is moved. The attachment of the string to a film, which is in turn attached to the zipper, avoids the need to attach to either end of the string to the zipper.

In the case where the closure and string are made of different materials, the closure and string are co-extruded through multiple openings in a die plate fed by respective extruders, one containing a first molten thermoplastic material for forming the zipper halves (through two die openings) and another containing a molten second thermoplastic material for forming the string (through a third die opening). As is well-known in the art, the die plate includes input ports, output ports, and channels connecting the input ports to the output ports. The extruders feed the different molten materials to different input ports, and the channels are designed to configure the molten materials into the shapes of the respective components. For example, the die plate may have a first output port for forming one zipper half with a female profile, a second output for forming the other zipper half with a male profile and a third output for forming a string. Since the closure and string are separate elements, it should be apparent that each may be formed in separate extrusions using different die plates. Alternatively, the closure and string can have the same polymeric composition. If the resulting zipper is to be operated by means of a slider, sliders are molded in a separate operation, e.g., by injection molding.

For the embodiment in which the string is joined to a film, one end of the latter being in turn joined to the zipper half having the groove for receiving the string, the string, film and zipper half can be extruded at the same time or extruded separately and later joined together.

In one method of manufacture, the zipper parts and string are extruded and assembled to form a zipper tape that can be wound on a spool and later fed to a slider insertion machine. This zipper tape with sliders inserted at intervals therealong can then be fed to a station where a zipper length is cut off the end of the zipper tape and a flange of the resulting zipper with slider is sealed to a web of packaging film. That film can then be fed to a form-fill-seal machine. After forming, filling and sealing, the other zipper flange can be sealed to the opposing wall of the package and the completed package is separated from the packaging film by cutting.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "package" means a container, bag, pouch or other receptacle for objects, material or stuff. A container, bag, pouch or other receptacle is deemed to be a package even if not yet packed with objects, material or stuff. As used in the claims, the verb "joined" means fused, bonded, sealed, or adhered whether by application of heat and/or pressure, application of ultrasonic energy, application of a layer of adhesive material or bonding agent, or interposition of an adhesive or bonding strip.

What is claimed is:

1. A fastener comprising first and second zipper parts and a string, wherein said first zipper part comprises a first interlockable portion and said second zipper part comprises a second interlockable portion on one side of said second zipper part and a first groove having an opening on an opposite side of said second zipper part, said first and second interlockable portions being mutually interlockable, and said string being seated in said first groove.

2. The fastener as recited in claim 1, wherein said string comprises first and second ends, said first end of said string being joined to a first end of said second zipper part.

3. The fastener as recited in claim 2, further comprising a pull tab joined to said second end of said string.

4. The fastener as recited in claim 1, wherein said first interlockable portion has a male profile and said second interlockable portion has a female profile.

5. The fastener as recited in claim 1, wherein said first groove has a mouth that is narrower than a maximum width of said first groove.

6. The fastener as recited in claim 1, further comprising a slider mounted to said first and second zipper parts, wherein said slider comprises a first surface that deflects said string into said first groove when said slider moves along said first and second zipper parts in a first direction.

7. The fastener as recited in claim 6, wherein said slider further comprises a finger inserted between said string and said second zipper part for extracting said string from said first groove when said slider moves along said first and second zipper parts in a second direction opposite to said first direction.

8. The fastener as recited in claim 6, wherein said slider further comprises a second surface that deflects said string out of said first groove when said slider moves along said first and second zipper parts in a second direction opposite to said first direction.

9. The fastener as recited in claim 1, further comprising a slider mounted to said first and second zipper parts, wherein said slider comprises a surface that deflects said string out of said first groove when said slider moves along said first and second zipper parts in a predetermined direction.

10. The fastener as recited in claim 1, wherein each of said first and second zipper parts comprises a respective step protruding from a respective top portion thereof.

11. The fastener as recited in claim 1, further comprising a film joined to said second zipper part, wherein said string is joined to said film.

12. The fastener as recited in claim 11, further comprising a slider having a leading portion that engages said first and second zipper parts and a lagging portion that presses said string inside said first groove when said slider is moved in a closing direction.

13. A fastener comprising first and second zipper parts and a string, wherein said first zipper part comprises a rib, and said second zipper part comprises a first body, a second body and a narrow strip connecting said first and second bodies, said first and second bodies and said narrow strip defining first and second grooves having respective openings on opposing sides of said second zipper part, wherein said first groove is profiled to receive and hold said string, while said second groove is profiled to receive and hold said rib.

14. A package comprising: a receptacle having an interior volume and a mouth; and a fastener comprising a string and first and second interlockable zipper parts that are interlocked to close said mouth and separated to open said mouth, wherein said first zipper part comprises a rib, and said second zipper part comprises a first body, a second body and a narrow strip connecting said first and second bodies, said first and second bodies and said narrow strip defining first and second grooves having respective openings on opposing sides of said second zipper part, said first groove being profiled to receive and hold said string, while said second groove is profiled to receive and hold said rib.

15. The package as recited in claim 14, wherein a first end of said string is joined to a first end of said second zipper part.

16. The package as recited in claim 14, wherein said receptacle comprises first and second walls, said first zipper part further comprises a first extension flange, and said second zipper part further comprises a second extension flange, said first and second walls having portions that are respectively joined to said first and second extension flanges.

17. The package as recited in claim 14, further comprising a slider mounted to said first and second zipper parts, wherein said slider comprises a first surface that deflects said string into said first groove when said slider moves along said first and second zipper parts in a first direction.

18. The package as recited in claim 17, wherein said slider further comprises a finger inserted between said string and said second zipper part for extracting said string from said first groove when said slider moves along said first and second zipper parts in a second direction opposite to said first direction.

19. The package as recited in claim 17, wherein said slider further comprises a second surface that deflects said string out of said first groove when said slider moves along said first and second zipper parts in a second direction opposite to said first direction.

20. The package as recited in claim 14, further comprising a slider mounted to said first and second zipper parts, wherein said slider comprises a surface that deflects said string out of said first groove when said slider moves along said first and second zipper parts in a predetermined direction.

21. A package comprising: a receptacle having an interior volume and a mouth; and a fastener comprising a string and first and second interlockable zipper parts that are interlocked to close said mouth and separated to open said mouth, wherein said first zipper part comprises a first interlockable portion, said second zipper part comprises a second interlockable portion on one side of said second zipper part and a first groove having an opening on an opposite side of said second zipper part, said first and second interlockable portions being mutually interlockable, and said string is at least partially insertable in said first groove.

22. A zipper tape comprising first and second plastic zipper parts and a plastic string having a constant profile, said first zipper part comprising a rib having a constant profile and said second zipper part comprising upper and lower bodies connected by a neck and forming first and second grooves of constant profile on opposite sides of said neck, said first groove being interlockable with said rib, and said string being at least partially insertable inside said second groove, wherein said neck forms a hinge allowing said upper body to pivot relative to said lower body to widen a mouth of said first groove when said string is not seated inside said second groove, said pivoting action being substantially blocked when said string is seated in said second groove.

23. The zipper tape as recited in claim 22 wherein said string has a circular profile and said second groove has an arc-shaped profile.

* * * * *